US011489269B2

(12) United States Patent
Tanaka et al.

(10) Patent No.: US 11,489,269 B2
(45) Date of Patent: Nov. 1, 2022

(54) TERMINAL CONNECTING STRUCTURE

(71) Applicant: Yazaki Corporation, Tokyo (JP)

(72) Inventors: Hiroyuki Tanaka, Kakegawa (JP); Masahiro Takamatsu, Makinohara (JP)

(73) Assignee: YAZAKI CORPORATION, Minato-ku (JP)

( * ) Notice: Subject to any disclaimer, the term of this patent is extended or adjusted under 35 U.S.C. 154(b) by 0 days.

(21) Appl. No.: 17/313,243

(22) Filed: May 6, 2021

(65) Prior Publication Data

US 2021/0376495 A1 Dec. 2, 2021

(30) Foreign Application Priority Data

May 27, 2020 (JP) ..... JP2020-091961

(51) Int. Cl.
*H01R 4/18* (2006.01)
*H01R 4/62* (2006.01)

(52) U.S. Cl.
CPC ..... *H01R 4/185* (2013.01); *H01R 4/62* (2013.01)

(58) Field of Classification Search
CPC ..... H01R 4/185; H01R 4/62
USPC ..... 439/868
See application file for complete search history.

(56) References Cited

U.S. PATENT DOCUMENTS 3,955,044 A * 5/1976 Hoffman ..... H01R 4/62 439/442
5,496,968 A * 3/1996 Katoh ..... H01R 4/20 439/879
7,828,610 B2 * 11/2010 Lehmann ..... H01R 4/187 29/860
2004/0053542 A1 * 3/2004 Gloaguen ..... H01R 4/62 439/877
2006/0292922 A1 * 12/2006 Froschl ..... H01R 4/029 439/442
2008/0032569 A1 * 2/2008 Steiner ..... B23K 20/10 228/110.1
2011/0094797 A1 4/2011 Otsuka et al.
2013/0072075 A1 * 3/2013 Kayamoto ..... C23C 28/021 427/123

(Continued)

FOREIGN PATENT DOCUMENTS

CN 107302143 A * 10/2017 ..... H01R 4/187
CN 206962034 U * 2/2018 ..... H01R 4/62

(Continued)

*Primary Examiner* — Peter G Leigh
(74) *Attorney, Agent, or Firm* — Sughrue Mion, PLLC

(57) ABSTRACT

An objective of the present invention is to provide a terminal connecting structure which may enable the conductivity to be improved. A terminal connecting structure is intended for connecting a terminal to an electric wire, the electric wire including an aluminum conductor with aluminum, wherein the terminal connecting structure further comprises a conductive connection body formed with aluminum, wherein one end of the connection body is butt-connected to the aluminum conductor, and wherein another end of the connection body is connected to the terminal via crimping. This enables the terminal to be connected to the electric wire via the connection body without crimping the bundle of cores. This may eliminate influence of crimping on the aluminum conductor and enable the conductivity between the electric wire and the terminal to be improved.

9 Claims, 3 Drawing Sheets

(56) References Cited

U.S. PATENT DOCUMENTS

| | | | | |
|---|---|---|---|---|
| 2017/0025769 | A1* | 1/2017 | Tokunaga | H01R 43/048 |
| 2018/0197660 | A1 | 7/2018 | Nabeta et al. | |
| 2019/0260145 | A1* | 8/2019 | Wang | H01R 4/625 |
| 2020/0161820 | A1* | 5/2020 | Wang | B23K 1/19 |

FOREIGN PATENT DOCUMENTS

| | | | | |
|---|---|---|---|---|
| DE | 102011011409 | A1 * | 8/2012 | H01R 11/11 |
| DE | 102013105669 | A1 * | 12/2013 | H01R 4/187 |
| DE | 102013101080 | B3 | 4/2014 | |
| EP | 1383201 | A1 * | 1/2004 | H01R 4/20 |
| FR | 2968138 | A1 * | 6/2012 | H01R 4/20 |
| JP | 58-49888 | U | 4/1983 | |
| JP | 2003-338350 | A | 11/2003 | |
| JP | 2018-113181 | A | 7/2018 | |
| WO | WO-2005091439 | A1 * | 9/2005 | H01R 4/023 |

* cited by examiner

TERMINAL CONNECTING STRUCTURE

BACKGROUND OF THE INVENTION

Technical Field

The present invention relates to a terminal connecting structure.

Background Art

An automobile is equipped with various types of electronic devices, wherein wire harnesses are arranged therein in order to transfer e.g. electric power and/or control signals to such electronic devices. A wire harness includes a plurality of electric wires and a connector, wherein the wire harness is connected to an electronic device or another wire harness by mating this connector to a connector of the electronic device or of the other wire harness.

For electric wires for forming such a wire harness, aluminum may be used as material for conductor cores. As a connecting structure for connecting a terminal to the aluminum electric wires having such aluminum conductor cores, a technique is disclosed in which when connecting the aluminum electric wire to the terminal, a ultrasound joint process is applied to a strand consisting of conductor cores to joint the conductor cores with each other and thus form a bundle of cores while destroying an oxide coating on surfaces of the conductor cores, wherein a terminal is connected to the bundle of cores via crimping so that the aluminum electric wires are connected to the terminal (e.g. see Patent Document 1).

CITATION LIST

Patent Literature

Patent Document 1: JP 2018-113181 A

SUMMARY OF THE INVENTION

However, in a conventional connecting structure, the bundle of cores is crimped by the terminal to connect the aluminum electric wires to the terminal, whereby crimping may cause the conductor cores forming the bundle of cores to be separated from each other to generate a gap between the conductor cores, so that an oxide coating may be formed on surfaces of the conductor cores, and thereby, the conductive connection between the aluminum electric wires and the terminals may be unstable after crimping.

An objective of the present invention is to provide a terminal connecting structure which may enable the conductivity to be improved.

In order to achieve the objective, the invention according to claim 1 provides a terminal connecting structure for connecting a terminal to an electric wire, the electric wire including an aluminum conductor with aluminum, wherein the terminal connecting structure further includes a conductive connection body formed with aluminum, wherein one end of the connection body is butt-connected to the aluminum conductor, and wherein another end of the connection body is connected to the terminal via crimping.

The invention according to claim 2 provides the terminal connecting structure according to claim 1, wherein the aluminum conductor is formed from a bundle of multiple aluminum strands, wherein the connection body includes an intersection face intersecting an axis of the electric wire, and wherein it is configured so that each of tip end faces of the multiple aluminum strands comes into contact with the intersection face to electrically connect the aluminum conductor to the connection body.

The invention according to claim 3 provides the terminal connecting structure according to claim 1 or 2, wherein the electric wire includes a coating section coating the aluminum conductor, and wherein the terminal integrally includes a connection body crimped section, a coating crimped section and a support section, wherein the connection body crimped section is configured to be crimped the another end of the connection body, the coating crimped section is configured to be crimped to the coating section, and the support section is disposed between the connection body crimped section and the coating crimped section and continuous with the connection body crimped section and the coating crimped section, the support section being configured to support the aluminum conductor and the one end of the connection body.

The invention according to claim 1 additionally provides the conductive connection body, wherein one end of the connection body is butt-connected to the aluminum conductor, and another end of the connection body is connected to the terminal via crimping. This enables the terminal to be connected to the electric wire via the connection body without crimping the crimped section to the bundle of cores as conventionally. This may eliminate influence of crimping on the aluminum conductor and enable the conductivity between the electric wire and the terminal to be improved.

DETAILED DESCRIPTION OF THE PREFERRED EMBODIMENTS

Figure 1:
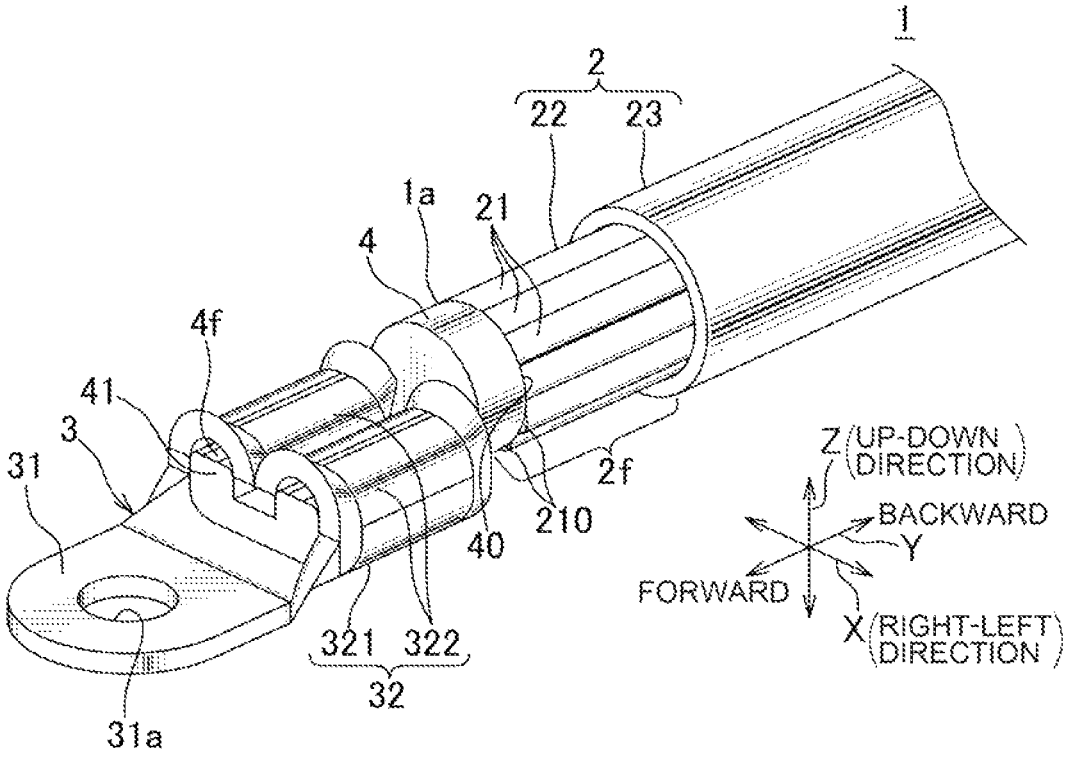
FIG. 1 is a perspective view of an electric wire with a terminal with a terminal connecting structure according to an embodiment of the present invention applied.

Hereinafter, an embodiment of the present invention will be described with reference to FIGS. 1 to 4. FIG. 1 shows a perspective view of an electric wire with a terminal according to an embodiment of the present invention. For the electric wire with the terminal 1 according to the present embodiment, a terminal connecting structure according to the present invention is applied, wherein the electric wire 1 constitutes a wire harness to be arranged e.g. in an automobile.

As shown in FIG. 1, the electric wire 1 includes a coated electric wire 2 (hereinafter referred to as "electric wire 2"), the terminal 3, and a connection body 4 for connecting the electric wire 2 to the terminal 3. According to the present embodiment, a direction in which the electric wire 2 and the connection body 4 are aligned is designated by an arrow Y, a direction (up-down direction) orthogonal to (intersecting)

the arrow Y is designated by an arrow Z, and a direction (right-left direction) orthogonal to both of the arrow Y and the arrow Z is designated by an arrow X. Further, the connection body 4 side may be referred to as "forward" and/or "front", while the electric wire 2 side opposed thereto may be referred to as "backward" and/or "back".

Figure 2:
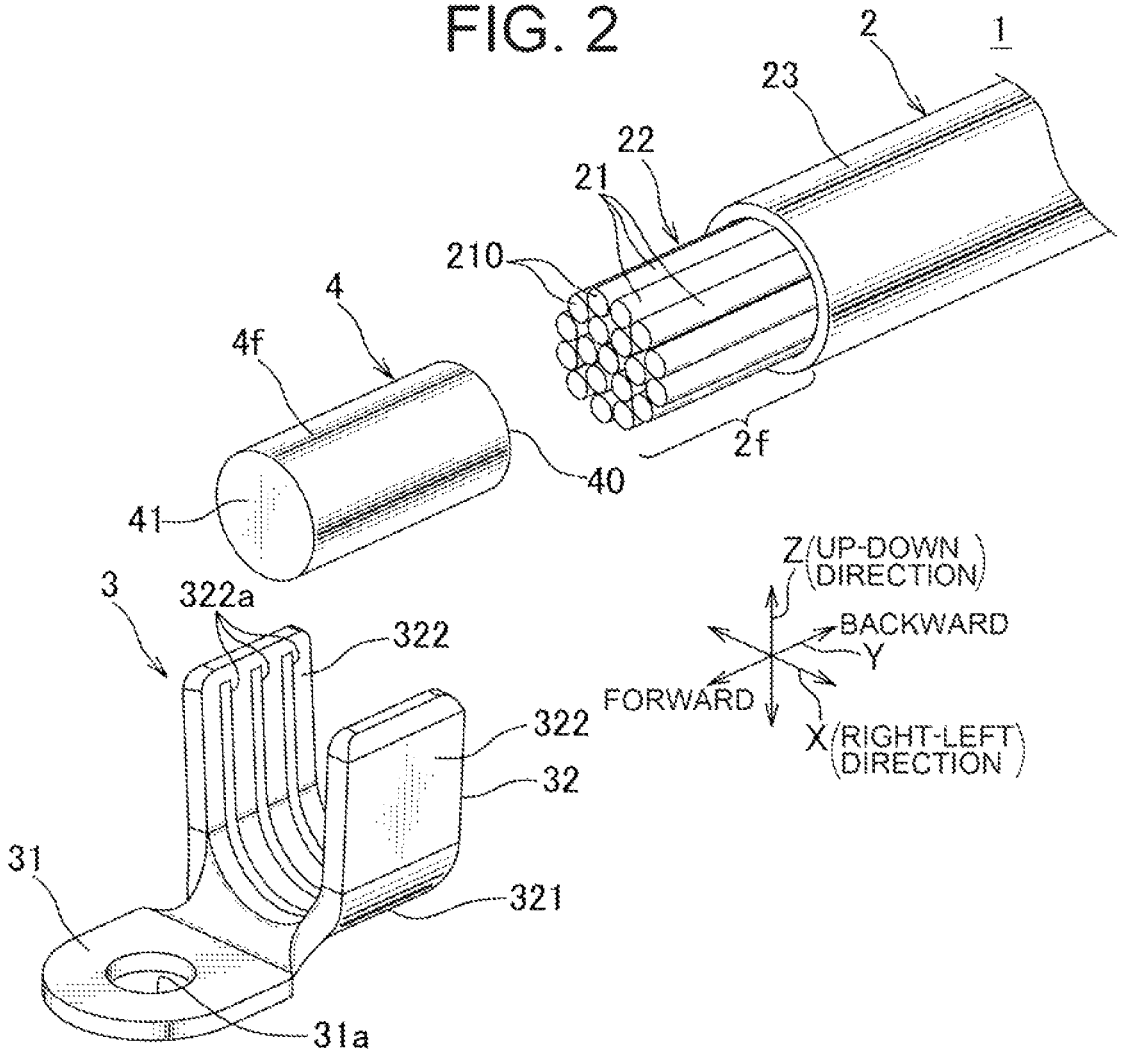
FIG. 2 is an exploded perspective view of the electric wire.

As shown in FIG. 2, the electric wire 2 includes a bundle of cores 22 (aluminum conductor) as a bundle of linear strands 21 having a conductivity, and a coating section 23 for applying an insulating coating to the bundle of cores 22. The electric wire 2 is arranged with its axis extending along the forward-backward direction (arrow Y). The strands 21 are formed with aluminum. In other words, the electric wire 2 is an aluminum electric wire or an aluminum-alloy electric wire. For this electric wire 2, the bundle of cores 22 is exposed by stripping off the coating section 23 at a front end portion 2*f* of the electric wire 2, as shown in FIG. 2.

Tips (front ends) of the multiple strands 21 are aligned in the forward-backward direction (arrow Y). This means that tip end faces 210 of the multiple strands 21 are configured so that they are positioned on a ZX-plane which extends orthogonally to the forward-backward direction. Further, the tip end faces 210 of the multiple strands 21 come into contact with a back end face 40 of the connection body 4 (one end of the connection body, intersection face), wherein the bundle of cores 22 is electrically connected (butt-connected) to the connection body 4. Here, the wording "butt-connection" means a condition where each of the tip end faces 210 of the multiple strands 21 is pressed against the back end face 40 of the connection body 4 so that the connection body 4 and the bundle of cores 22 are electrically connected to each other, as shown in FIG. 1. A connecting portion 1*a* (shown in FIG. 1) between the connection body 4 and the bundle of cores 22 may be jointed by means of melting or welding in order to maintain an electrically connected state between the connection body 4 and the bundle of cores 22.

Figure 4:
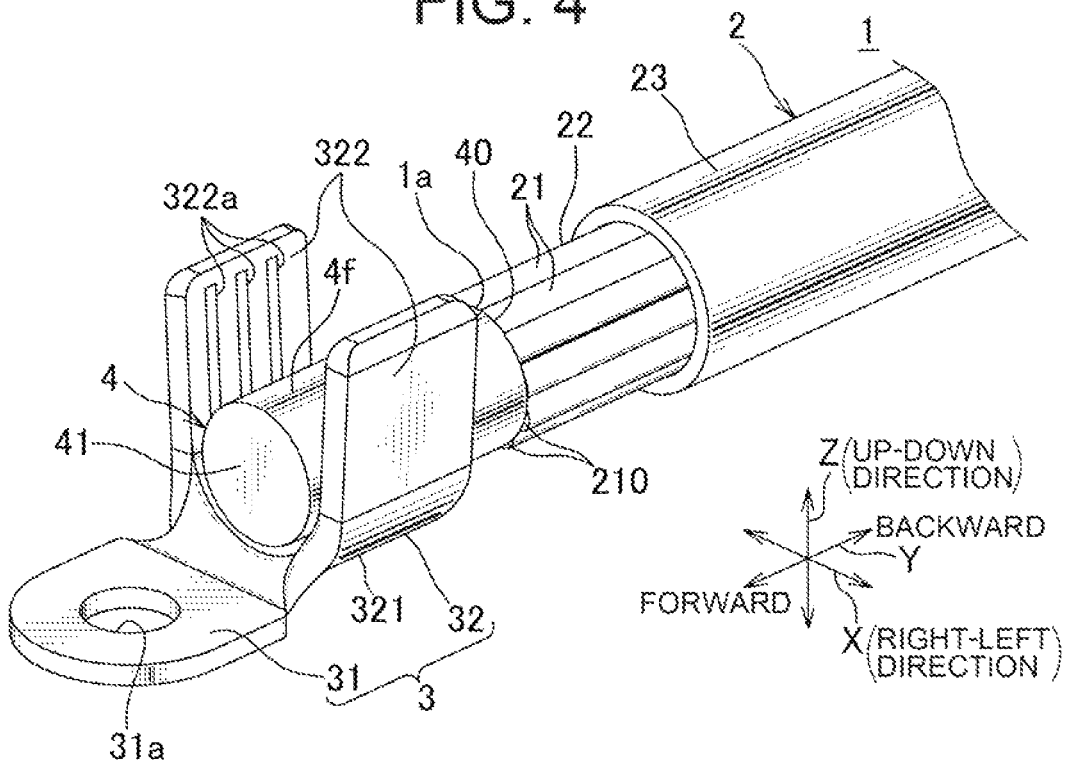
FIG. 4 is a view for illustrating an assembly procedure of the electric wire, showing a perspective view in which another end of the connection body is connected by the terminal via crimping.

As shown in FIG. 2, the terminal 3 includes a partner connecting section 31 and a connection body crimped section 32, the connection body crimped section 32 being configured to be connected to a front portion 4*f* of the connection body 4 (another end of the connection body) via crimping. According to the present embodiment, the partner connecting section 31 has a bolt hole 31*a* and is formed in a plate-shape. The connection body crimped section 32 includes a first bottom plate 321 and a pair of connection body crimped elements 322, 322, the first bottom plate 321 being continuous with a back side of the partner connecting section 31, wherein the pair of connection body crimped elements 322, 322 extends from a right and left ends of the first bottom plate 321 (ends in the direction of the arrow X) and is configured to be connected to the front portion 4*f* of the connection body 4 via crimping. Further, an inner surface of the connection body crimped section 32 (a surface which comes into contact with the connection body 4) has three (a plurality of) ridges 322*a* formed thereon, wherein the ridges 322*a* are formed convexly on the inner surface and lead continuously from the first bottom plate 321 to each of the connection body crimped elements 322, 322, as shown in FIGS. 2 and 4. Each of the ridges 322*a* bites into the connection body 4 as described below when the pair of connection body crimped elements 322, 322 are crimped to the connection body 4, wherein each of the ridges 322*a* thereby increases the reliability for mechanical connection and electrical connection between the connection body crimped section 32 and the connection body 4.

Figure 3:
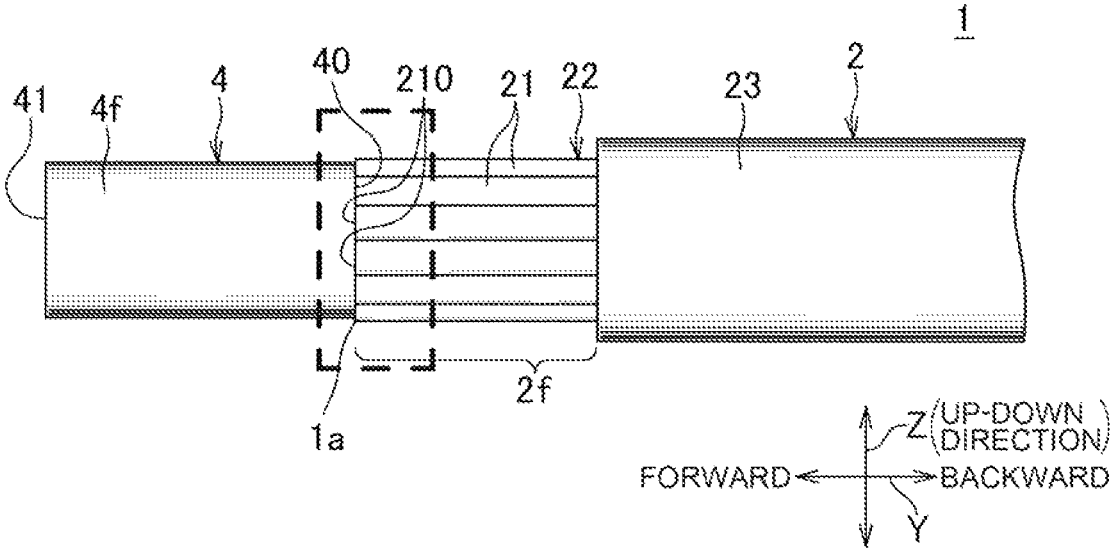
FIG. 3 is a view for illustrating an assembly procedure of the electric wire, showing a plan view in which one end of a connection body is butt-connected to an aluminum conductor of the electric wire.

The connection body 4 is formed with aluminum. As shown in FIGS. 2 and 3, this connection body 4 is configured in a cylindrical shape before the connection body crimped section 32 of the terminal 3 is crimped. Then, the pair of connection body crimped elements 322, 322 of the connection body crimped section 32 of the terminal 3 is connected to the front portion 4*f* of the connection body 4 via crimping, wherein the tip end face 210 of each of the strands 21 is butt-connected to the back end face 40 of the connection body 4. The "front portion 4*f*" of the connection body 4 refers to a portion of the connection body 4 which includes a region extending from the front end 41 of the connection body 4 to a middle portion of the connection body 4 in the forward-backward direction. As shown in FIG. 3, the back end face 40 of the connection body 4 extends in the ZX-plane orthogonal to the forward-backward direction (arrow Y) so that the back end face 40 is opposed to each of the tip end faces 210 of the multiple strands 21.

Such an electric wire 1 with the terminal is assembled according to the following procedure. First, the coating section 23 is stripped off at the front end portion 2*f* of the electric wire 2 to expose the bundle of cores 22, as shown in FIG. 2. Then, the front portion 4*f* of the connection body 4 is placed on the first bottom plate 321, the tip end face 210 of each of the strands 21 is butt-connected to the back end face 40 of the connection body 4, and the pair of connection body crimped elements 322, 322 is brought close to the front portion 4*f* of the connection body 4 and then crimped thereto, as shown in FIG. 4. In this manner, the electric wire 2 and the terminal 3 are electrically connected to each other via the connection body 4 to produce the complete electric wire 1 with the terminal.

The embodiment as described above enables the terminal 3 to be connected to the electric wire 2 via the connection body 4 without crimping the bundle of cores 22. This may eliminate influence of crimping on the bundle of cores 22 (aluminum conductor) and enable the conductivity between the electric wire 2 and the terminal 3 to be improved.

Further, the bundle of cores 22 (aluminum conductor) is formed from the bundle of multiple strands 21 (aluminum strands), wherein the connection body 4 includes the back end face 40 (intersection face) intersecting the axis of the electric wire 2, and wherein it is configured so that each of the tip end faces 210 of the multiple strands 21 comes into contact with the back end face 40 to electrically connect the bundle of cores 22 to the connection body 4. In this manner, it is possible to electrically connect all the strands 21 to the connection body 4.

It is to be noted that the present invention is not limited to the above-described embodiment, but includes other embodiments which can achieve the objective of the present invention, wherein the present invention also includes variations as described below.

Figure 5:
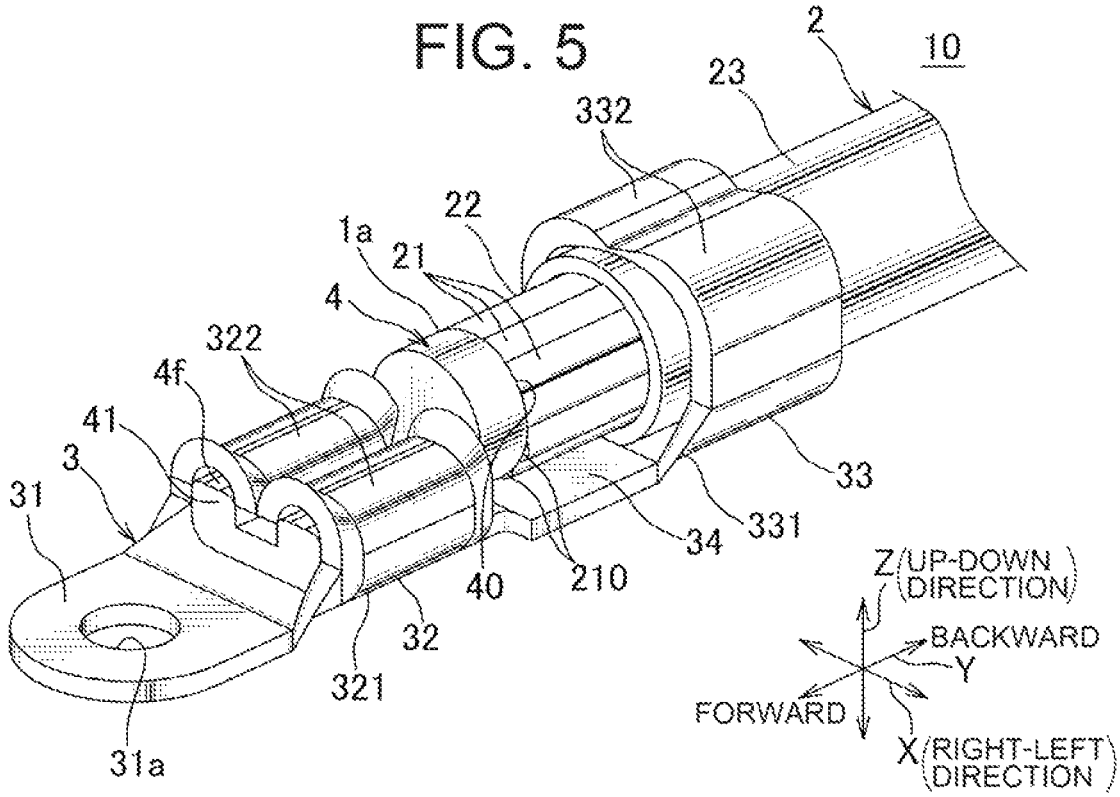
FIG. 5 is a perspective view of an exemplary variation of the electric wire.

According to the above-described embodiment, the terminal 3 is configured with the partner connecting section 31 and the connection body crimped section 32 to be connected to the front portion 4*f* of the connection body 4 (another end of the connection body) via crimping. However, the present invention is not limited thereto. As shown in FIG. 5, the terminal 3 may integrally include the partner connecting section 31, the connection body crimped section 32, the coating crimped section 33 and the plate-shaped support section 34, wherein the connection body crimped section 32 is configured to be connected to the front portion 4*f* of the connection body 4 via crimping, the coating crimped section 33 is configured to be crimped to the coating section 23 of the electric wire 2, and the support section is disposed between the connection body crimped section 32 and the coating crimped section 33 and continuous with the connection body crimped section 32 and the coating crimped section 33, the support section 34 being configured to support the connecting portion 1*a* between the bundle of cores 22 and the connection body 4. It is to be noted that the same elements in FIG. 5 as those in FIGS. 1 to 4 which have been already described in the above-described embodiment are designated by the same reference signs and the corresponding detailed description will be omitted.

The coating crimped section 33 includes a second bottom plate 331 and a pair of coating crimped elements 332, 332, the second bottom plate 331 being continuous with a back side of the support section 34, wherein the pair of coating crimped elements 332, 332 extends from a right and left ends of the second bottom plate 331 and is configured to be connected to the coating section 23 of the electric wire 2 via crimping.

The support section 34 is formed in a plate shape extending in a plane direction, wherein the plane direction includes the XY-direction. The support section 34 is disposed between the first bottom plate 321 of the connection body crimped section 32 and the second bottom plate 331 of the coating crimped section 33 and continuous with the first and second bottom plates 321 and 331, wherein the support section 34 is configured for placing the connecting portion 1*a* between the bundle of cores 22 and the connection body 4 thereon.

Such an electric wire 10 with the terminal is assembled according to the following procedure. First, the front portion 4*f* of the connection body 4 is placed on the first bottom plate 321, and the pair of connection body crimped elements 322, 322 is brought close to the front portion 4*f* and then crimped thereto. Next, the bundle of cores 22 of the electric wire 2 is placed on the support section 34, and the tip end face 210 of each of the strands 21 is butt-connected to the back end face 40 of the connection body 4. Subsequently, the coating section 23 of the electric wire 2 is placed on the second bottom plate 331, and the pair of coating crimped elements 332, 332 is brought close to the coating section 23 and crimped thereto. At this time, the connecting portion 1*a* (shown in FIG. 5) between the bundle of cores 22 and the connection body 4 may be jointed by means of melting or welding in order to stabilize the electrically connected state between the connection body 4 and the bundle of cores 22. However, when the electrically and mechanically connected state between the connection body 4 and the electric wire 2 is sufficiently maintained by the connection body crimped section 32, the coating crimped section 33 and the support section 34, it is not necessary to joint the connecting portion 1*a* by means of melting or welding.

According to the embodiment as described above, the terminal 3 integrally includes the connection body crimped section 32, the coating crimped section 33 and the support section 34, wherein the connection body crimped section 32 is crimped to the front portion 4*f* of the connection body 4 (another end of the connection body), and the coating crimped section 33 is crimped to the coating section 23 of the electric wire 2. This results in that a portion of the connection body 4 (connecting portion 1*a*) which is the back end face 40 (one end of the connection body) and butt-connected to the bundle of cores 22 (aluminum conductor) is supported by the support section 34 more stably. This may enable the conductivity between the electric wire 2 and the terminal 3 to be further improved.

Although the best configuration, method etc. for implementing the present invention are disclosed in the above description, the present invention is not limited thereto. Namely, while the present invention is particularly shown and described mainly with regard to the specific embodiments, the above mentioned embodiments may be modified in various manners in shape, material characteristics, amount or other detailed features by those skilled in the art without departing from the scope of the technical idea and purpose of the present invention. Therefore, the description with limited shapes, material characteristics etc. according to the above disclosure is not limiting the present invention, but merely illustrative for easier understanding the present invention so that the description using names of the elements without a part or all of the limitations to their shapes, material characteristics etc. is also included in the present invention.

REFERENCE SIGNS LIST

1, 10 Electric wire with a terminal (terminal connecting structure)
2 Electric wire
21 Strands (aluminum strands)
22 Bundle of cores (aluminum conductor)
23 Coating section
210 Tip end faces of the respective strands
3 Terminal
32 Connection body crimped section
33 Coating crimped section
34 Support section
4 Connection body
4*f* Front portion of the connection body (another end of the connection body)
40 Back end face of the connection body (one end of the connection body, intersection face)

What is claimed is:

1. A terminal connecting structure for connecting a terminal to an electric wire, the electric wire including an aluminum conductor with aluminum, wherein the terminal connecting structure further comprises:
- a conductive connection body formed with aluminum,
- wherein the terminal includes a connection body crimped section,
- wherein the connection body crimped section includes a pair of connection body crimped elements connected to the connection body via crimping,
- wherein one end of the connection body is butt-connected to the aluminum conductor, and
- wherein another end of the connection body is connected to the pair of connection body crimped elements via crimping and only the connection body is crimped.

2. The terminal connecting structure according to claim 1,
- wherein the terminal includes a partner connecting section, and
- wherein the partner connecting section has a bolt hole and is formed in a plate-shape.

3. The terminal connecting structure according to claim 1,
- wherein the aluminum conductor is formed from a bundle of the multiple aluminum strands,
- wherein the connection body comprises an intersection face intersecting an axis of the electric wire, and
- wherein it is configured so that each of the tip end faces of the multiple aluminum strands comes into contact with the intersection face to electrically connect the aluminum conductor to the connection body.

4. The terminal connecting structure according to claim 2,
wherein the aluminum conductor is formed from a bundle of multiple aluminum strands,
wherein the connection body comprises an intersection face intersecting an axis of the electric wire, and
wherein it is configured so that each of tip end faces of the multiple aluminum strands comes into contact with the intersection face to electrically connect the aluminum conductor to the connection body.

5. A terminal connecting structure for connecting a terminal to an electric wire, the electric wire including an aluminum conductor with aluminum, wherein the terminal connecting structure further comprises:
a conductive connection body formed with aluminum,
wherein one end of the connection body is butt-connected to the aluminum conductor, and
wherein another end of the connection body is connected to the pair of connection body crimped elements via crimping and only the connection body is crimped,
wherein the electric wire comprises a coating section coating the aluminum conductor,
wherein the terminal integrally comprises:
a connection body crimped section configured to be crimped to the another end of the connection body;
a coating crimped section configured to be crimped to the coating section; and
a support section disposed between the connection body crimped section and the coating crimped section, wherein the support section is continuous with the connection body crimped section and the coating crimped section, and configured to support the aluminum conductor and the one end of the connection body.

6. The terminal connecting structure according to claim 1,
wherein the electric wire comprises a coating section coating the aluminum conductor,
wherein the terminal integrally comprises:
a connection body crimped section configured to be crimped to the another end of the connection body;
a coating crimped section configured to be crimped to the coating section; and
a support section disposed between the connection body crimped section and the coating crimped section, wherein the support section is continuous with the connection body crimped section and the coating crimped section, and configured to support the aluminum conductor and the one end of the connection body.

7. The terminal connecting structure according to claim 2,
wherein the electric wire comprises a coating section coating the aluminum conductor,
wherein the terminal integrally comprises:
a connection body crimped section configured to be crimped to the another end of the connection body;
a coating crimped section configured to be crimped to the coating section; and
a support section disposed between the connection body crimped section and the coating crimped section, wherein the support section is continuous with the connection body crimped section and the coating crimped section, and configured to support the aluminum conductor and the one end of the connection body.

8. The terminal connecting structure according to claim 3,
wherein the electric wire comprises a coating section coating the aluminum conductor,
wherein the terminal integrally comprises:
a connection body crimped section configured to be crimped to the another end of the connection body;
a coating crimped section configured to be crimped to the coating section; and
a support section disposed between the connection body crimped section and the coating crimped section, wherein the support section is continuous with the connection body crimped section and the coating crimped section, and configured to support the aluminum conductor and the one end of the connection body.

9. The terminal connecting structure according to claim 4,
wherein the electric wire comprises a coating section coating the aluminum conductor,
wherein the terminal integrally comprises:
a connection body crimped section configured to be crimped to the another end of the connection body;
a coating crimped section configured to be crimped to the coating section; and
a support section disposed between the connection body crimped section and the coating crimped section, wherein the support section is continuous with the connection body crimped section and the coating crimped section, and configured to support the aluminum conductor and the one end of the connection body.

* * * * *